US005105879A

United States Patent [19]

Ross

[11] Patent Number: 5,105,879

[45] Date of Patent: Apr. 21, 1992

[54] METHOD AND APPARATUS FOR SEALING AT A SLIDING INTERFACE

[75] Inventor: Richard J. Ross, Houston, Tex.

[73] Assignee: Baker Hughes Incorporated, Houston, Tex.

[21] Appl. No.: 672,400

[22] Filed: Mar. 20, 1991

[51] Int. Cl.[5] ..... E21B 33/00

[52] U.S. Cl. ..... 166/195; 297/27; 297/65; 297/235 A

[58] Field of Search ..... 166/179, 195, 336, 312, 166/181; 297/22, 65, 84, 235 A

[56] References Cited

U.S. PATENT DOCUMENTS

| | | | |
|---|---|---|---|
| Re. 30,401 | 9/1980 | White . | |
| 248,784 | 10/1881 | Page . | |
| 1,336,738 | 4/1920 | Fletcher . | |
| 2,826,254 | 3/1958 | O'Neill | 166/179 |
| 3,595,588 | 7/1971 | Rode . | |
| 3,690,685 | 9/1972 | Porner et al. . | |
| 4,079,948 | 3/1978 | Paureau . | |
| 4,224,987 | 9/1980 | Allen | 166/179 |
| 4,342,631 | 8/1982 | White et al. . | |
| 4,420,386 | 12/1983 | White . | |
| 4,438,936 | 3/1984 | Schlegel | 277/65 |
| 4,468,309 | 8/1984 | White . | |
| 4,752,077 | 6/1988 | Hoffelner | 277/22 |
| 4,828,272 | 5/1989 | Pederson | 277/84 |

OTHER PUBLICATIONS

SPE Article 13224 Elastomers are Being Eliminated in Subsurface Completion Equipment.

OTC 6087 Metallic Sealing Technology in Downhole Completion Equipment.

SPE 12209 Eliminating Galling of High-Alloy Tubular Threads by High-Energy Ion Deposition Process.

Talivaldis Spalvins, "Coatings for Wear and Lubrication", 1978, pp. 285-300.

D. M. Mattox, "Commercial Applications of Overlay Coating Techniques", 1981, pp. 361-365.

Lewis Beebe Leder, "Fundamental Parameters of Ion Plating" Mar., 1974, pp. 41-45.

D. M. Mattox, "Fundamentals of Ion Plating", 1972, pp. 47-52.

Talivaldis Spalvins and Bruno Buzek, "Frictional and Morphological Characteristics of Ion-Plated Soft Metallic Films", 1981, pp. 267-272.

R. Swaroop, D. E. Meyer and G. W. White, "Abstract: Ion-Plated Oxide Coatings for Protection Against Corrosion", 1975, p. 531.

Talivaldis Spalvins, "Tribological Properties of Sputtered $MoS_2$ Films in Relation to Film Morphology", 1980, pp. 291-297.

D. E. Meyer & G. W. White, "Ion-Plated Thick Films of $Al_2O_3$ On Stainless Steels and Inconel", 1976, pp. 319-326.

A. J. Aronson, D. Chen and W. H. Class, "Preparation of Titanium Nitride by a Pulsed D. C. Magnetron Reactive Deposition Technique Using the Moving Mode of Deposition", pp. 535-540.

B. Swaroop, D. E. Meyer and G. W. White, "Ion--Plated Aluminum Oxide Coatings for Protection Against Corrosion", pp. 680-683.

Talivaldis Spalvins, "Morphological and Frictional Behavior of Sputtered $MoS_2$ Films", 1982, pp. 17-24.

S. Aisenberg and R. W. Chabot, "Physics of Ion Plating and Ion Beam Deposition", 1972, pp. 104-107.

*Primary Examiner*—Ramon S. Britts

*Assistant Examiner*—Frank S. Tsay

*Attorney, Agent, or Firm*—Melvin A. Hunn

[57] ABSTRACT

A seal is provided for containing fluid (either gaseous or liquid fluids) under variable pressure in a pressurized region to prevent leakage into a less pressurized region. First and second interfacing seal members are provided and adapted to slidably engage one another at an interface region during makeup of the seal apparatus. A seal region is carried by the first seal member at the interface region and composed of a deformable material. A seal bead is carried at the interface region by the second seal member and protrudes therefrom. The seal bead is composed of a material less malleable than the seal region for seating in the seal region. At least a portion of the second seal member adjacent the seal bead forms a containment barrier with the pressurized region on one side and the less-pressurized region on the opposite side. A pressure differential will develop between the pressurized region and the less-pressurized region which urges the seal bead into tighter engagement with the seal region in an amount corresponding to the pressure differential.

42 Claims, 7 Drawing Sheets

METHOD AND APPARATUS FOR SEALING AT A SLIDING INTERFACE

BACKGROUND OF THE INVENTION

1. Field of the Invention

The present invention relates generally to seals, and in particular to methods and apparati for sealing at a sliding interface.

2. Description of the Prior Art

In the oil and gas industry, tight seals are frequently required to seal regions which contain extremely corrosive, high temperature, and high pressure fluids, both liquid and gaseous. The sealing task is further complicated by the inaccessibility of the regions to be sealed, which in wellbores are frequently thousands of feet below the earth's surface.

Conventional seals which include rubber components are susceptible to disintegration if continually exposed to the corrosive wellbore fluids. Metal or plastic materials may produce longer lasting seals, but known metal seals such as conventional C-ring and V-ring seals, which are depicted in FIGS. 1*a* and 1*b*, are not suitable for use in such hostile environments. Such seals are suitable for use only in rather pristine environments. Furthermore, conventional C-ring and V-ring seals are not able to withstand axial or sliding movement, since such movement would degrade or destroy the seals.

It is one objective of the present invention to provide a seal which operates at a sliding interface of slidably engaged seal members.

It is another objective of the present invention to provide a seal which increases and decreases in sealing engagement in response to changes in pressure of the contained fluid.

It is yet another objective of the present invention to provide a seal which is adapted for use in a wellbore and is composed of a pair of interlocking wellbore tubular members.

It is still another objective of the present invention to provide a sliding interface seal which may be assembled, disassembled, or adjusted by sliding one seal member relative to another seal member under low-pressure differential conditions.

These and other objectives are achieved as is now described. A seal is provided for containing fluid (either gaseous or liquid fluids) under variable pressure in a pressurized region to prevent leakage of the fluid into a less-pressurized region. First and second interfacing seal members are provided and adapted to slidably engage one another at an interface region during makeup of the seal apparatus. A seal region is carried by the first seal member at the interface region and is composed of a deformable material. A seal bead is carried at the interface region by the second seal member and protrudes therefrom. The seal bead is composed of a material harder and less malleable than the seal region, and is adapted for seating in the seal region At least a portion of the second seal member adjacent the seal bead forms a containment barrier with the pressurized region on one side, and the less-pressurized region on the opposite side A pressure differential will develop between the pressurized region and the less-pressurized region which urges the seal bead into tighter engagement with the seal region in an amount corresponding to the pressure differential.

In the preferred embodiment, the first and second seal members comprise concentrically interlocking tubular members, and the seal bead is semi-circular in cross-section. Furthermore, in the preferred embodiment, the seal region comprises at least one seal coating disposed on the first seal member at the interface region.

As a method, the present invention includes a number of steps which prevent the passage of pressurized fluid from a pressurized region into a less-pressurized region. First and second interlocking seal members are provided. A deformable seal coating is provided on the first seal member. A protruding seal bead is provided on the second seal member. The first and second interlocking seal members slide together, with the seal bead extending into the deformable layer The seal bead is forced into tighter contact with the seal coating, in an amount corresponding to the pressure differential between the pressurized region and the less-pressurized region. Therefore, the magnitude of the sealing engagement between the first and second seal members will vary in response to changes in pressure of the pressurized fluid.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1A:
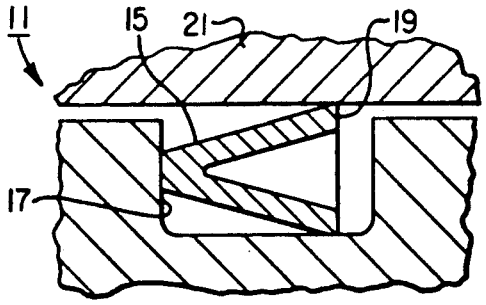
FIG. 1a (PRIOR ART)
FIGS. 1*a* and 1*b* respectively depict a prior art metal V-ring static seal and a prior art metal C-ring static seal.
Figure 1B:
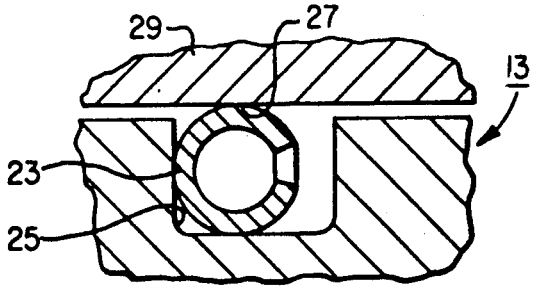
FIG. 1b (PRIOR ART)

FIGS. 1*a* and 1*b* respectively depict prior art V-ring and C-ring seals. In FIG. 1*a*, a prior art V-ring seal 11 is depicted in cross-section. V-shaped seal member 15 is disposed within seal compartment 17, and includes a soft seal point 19, which interfaces with hard seal surface 21 to form a static seal. Pressure from the fluid contained in the sealed region acts on V-ring seal 11 to urge soft seal point 19 into sealing engagement with hard seal surface 21. FIG. 1*b* depicts C-ring seal 13 in cross-section. C-shaped seal member 23 is disposed in seal compartment 25, and includes soft seal point 27, which engages hard seal surface 29. Pressure from the sealed fluid likewise acts on C-shaped seal member 23 to urge soft seal point 27 into sealing engagement with hard seal surface 29.

As discussed above, V-ring and C-ring seals 11, 13 are not suitable for use in environments which would subject the seals to movement, since movement of the hard seal surfaces 21, 29 relative to soft seal points 19, 27 would degrade or destroy the ability of V-ring and C-ring seals 11, 13 to maintain a sealing engagement.

Figure 2A:
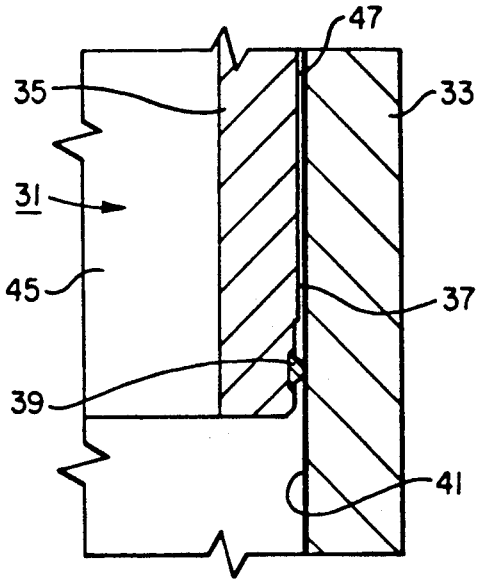
FIGS. 2*a* and 2*b* depict the sliding interface seal of the present invention during a makeup mode wherein first and second interfacing seal members are slidable engaged.
Figure 2B:
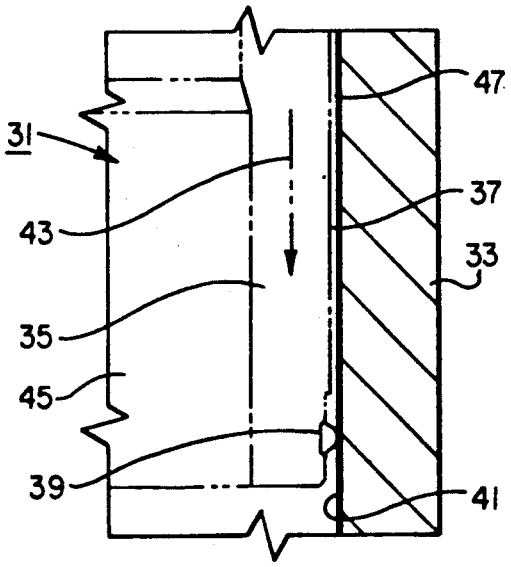

The present invention is a method and apparatus for sealing at a sliding interface between seal members. FIGS. 2*a* and 2*b* depict sliding interface seal 31 in two positions. As shown, first seal member 33 interfaces with second seal member 31 at interface region 37. A seal region 41 is carried by first seal member 33, and a seal bead 39 is carried by second seal member 35. Seal bead 39 operates to seat within seal region 41 and form a bubble-tight seal between pressurized region 45 and less-pressurized region 47.

Sliding interface seal 31 may be assembled, disassembled, or repositioned by moving first and second seal members 35, 33 relative to one another. FIGS. 2*a*, and 2*b* depict the positioning of the seal by movement of second seal member 35 relative to first seal member 33 along the direction of arrow 43 of FIG. 2*b*. Of course, second seal member 33 could be moved in the opposite direction also. Accordingly, the sliding interface seal 31 of the present invention includes the benefits of a tight seal, but allows for a movable "dynamic" seal, as opposed to a static seal, such as a V-ring or C-ring seal 11, 13.

Figure 3:
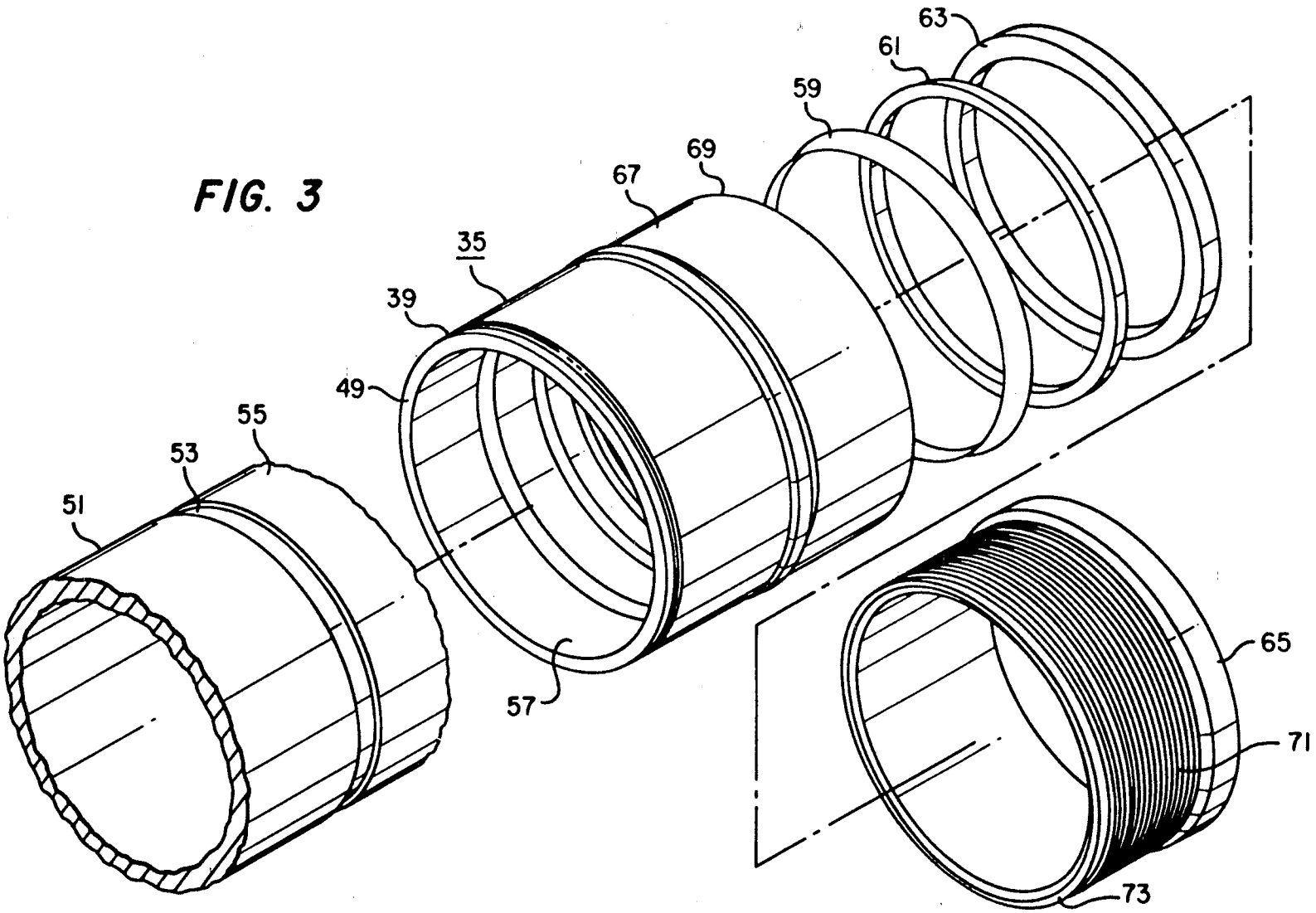
FIG. 3 depicts, in exploded form, one embodiment of the second seal member of the sliding interface seal of the present invention including the assembly used for holding said second seal member in place within a wellbore.

FIG. 3 is an exploded view of one embodiment of the second seal member of the sliding interface seal 31 of the present invention. In this embodiment, second seal member 35 is cylindrical in shape. However, it should be understood that first and second seal members 33, 35 need not be cylindrical in shape, and could in fact be formed in other shapes.

As shown in FIG. 3, seal bead 39 is circumferentially disposed along the outer cylindrical surface 67 of cylindrical-shaped second seal member 35 adjacent lower end 49 thereof. Cylindrical-shaped second seal member 35 includes internal threads, which are obscured from view in FIG. 3, at upper end 69 which mate with external threads 71 of seal retainer member 65.

Cylindrical-shaped second seal member 35 is lowered into a wellbore connected to mandrel 51. Second seal member 35 is secured to mandrel 51 by split ring 63 which rides in-part in split ring groove 53 on exterior cylindrical surface 55 of mandrel 51. Split ring 63 is abutted on one side by lower end 73 of seal retainer member 65, and on the other side by spacer 61. Spacer 61 is next to soft brass ring 59 which abuts central bore 57 of second seal member 35. The interconnection of these components is more clearly set forth in FIG. 4, which is a one-quarter longitudinal section of one embodiment of the sliding interface seal of the present invention.

Figure 4:
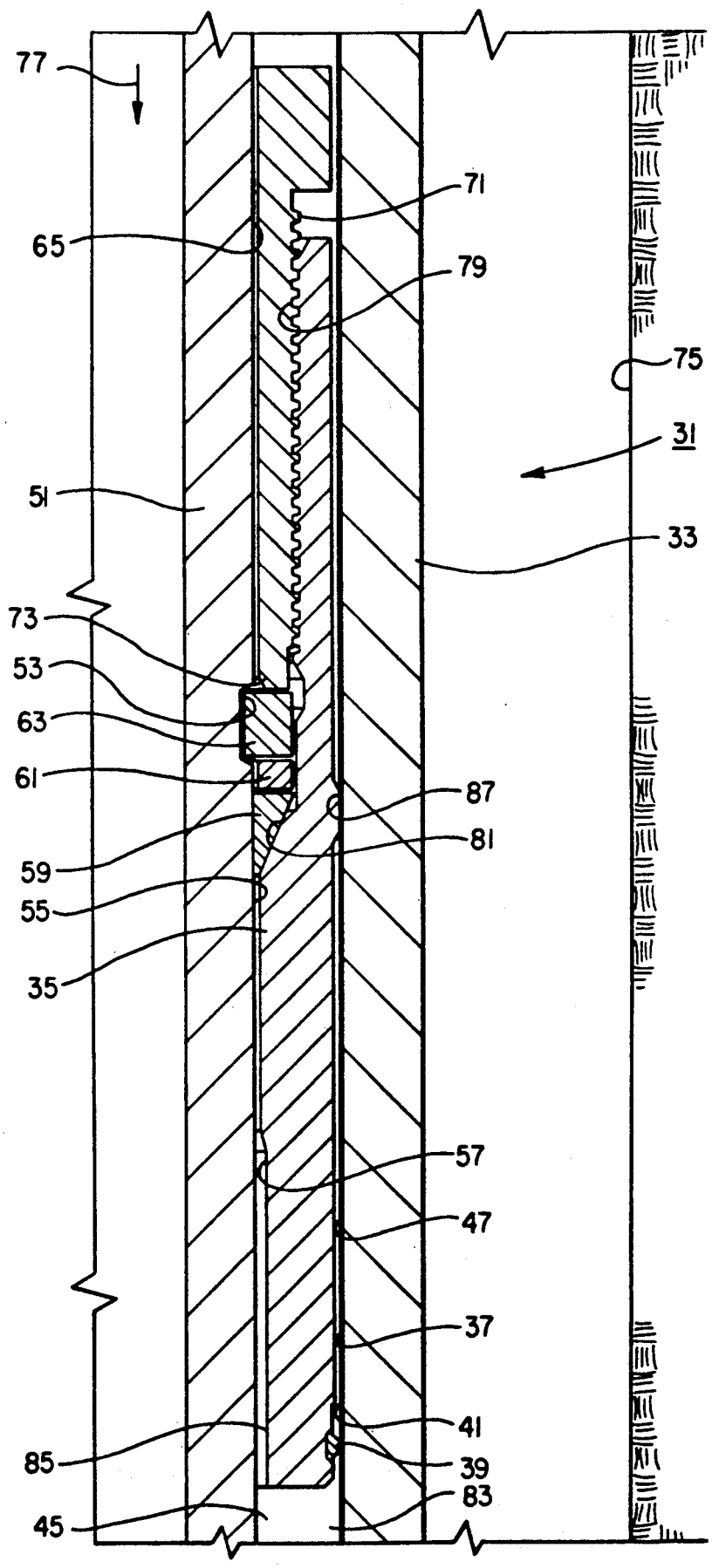
FIG. 4 depicts the embodiment of the sliding interface seal of FIG. 3 disposed within a wellbore, in one-quarter longitudinal section.

As shown in FIG. 4, sliding interface seal 31 is disposed within wellbore 75. Preferably, first seal member 33 is a cylindrical wellbore tubular member which is disposed in a fixed position within wellbore 75. In the preferred embodiment, first seal member 33 comprises a cylindrical tubular member; however, it should be understood that the present invention is not limited in shape to cylindrical members, and can be employed with other shapes. Second seal member 35 rides on the exterior surface of mandrel 51, and is lowered within wellbore 75. Mandrel 51 and second seal member 35 are held together by split ring 63 which is disposed in part in split ring groove 53 on the exterior cylindrical surface 55 of mandrel 51.

Split ring 63 is held in place from above by seal retainer member 65 which is coupled to second seal member 35 by external threads 71 and internal threads 79. From below, split ring 63 is held in place by spacer 61 and soft brass ring 59. Soft brass ring 59 is disposed at tapered region 81 of central bore 57 of second seal member 35. When seal retainer member 65 and second seal member are made-up, soft brass ring is compressed between tapered region 81 and mandrel 51 to form a static seal.

As shown in FIG. 4, seal bead 39 is disposed at the lower end of second seal member 35, and is in sliding engagement with first seal member 33 at interface region 37. In particular, seal bead 39 extends into seal region 41 to form a tight seal to prevent the passage of pressurized fluid 83 from pressurized region 45 to less-pressurized region 47.

As shown in FIG. 4, second seal member 35 forms a containment barrier with pressurized region 45 on one side and less-pressurized region 47 on the opposite side. Boost area 85 is disposed radially inward from seal bead 39, and communicates with pressurized region 45. When a pressure differential is developed between pressurized region 45 and less-pressurized region 47, seal bead 39 is urged into a tighter engagement with seal region 41 in an amount corresponding to the pressure differential, since boost area 85 will flex slightly radially outward. Second seal member 39 makes contact with first seal member 33 at seal bead 39 and shoulder 87. The force of the pressure differential developed between pressurized region 45 and less-pressurized region 47 is distributed between seal bead 39 and shoulder 87. As a pressure differential is developed, second seal member 35 will flex slightly radially outward, causing seal bead 39 to dig into seal region 41 of first seal member 33. The amount of flexing of second seal member 35 will depend upon the ratio of the surface area of boost area 85, the distance of circumferential contact of bead 39, the strength and dimensions of the material which comprises the boost area 85, the location of shoulder 87, and the pressure differential. In the preferred embodiment, boost area 85 is one inch long, and covers a total area of 21.6 square inches. Shoulder 87 is disposed 2.5 inches from seal bead 39. The wall which forms boost area 85 is comprised of 4130 steel and is 0.22 inches thick. The line of contact of seal bead 39 is 23.2 inches. The ratio of boost area to line contact of seal bead 39 is approximately one-to-one when these dimensions and materials are employed.

In the preferred embodiment, sliding interface seal 31 of the present invention is made up by sliding second seal member 35 downward within wellbore 75 in the direction of arrow 77. In the preferred embodiment, in wellbore applications, sliding interface seal 31 of the present invention includes a seal region 41 which is twelve to fourteen feet in length. Preferably, the cylindrical tubular member of first seal member 31 has an inner diameter of seven and three-eights inches (7⅜"). Also, in the preferred embodiment, seal bead 39 is machined to be 0.020 inches larger than the bore of first seal member 33. Second seal member 35 is press fit into first seal member 33, putting a very high load on seal bead 39. In the preferred embodiment, this load exceeds 3,000 pounds per inch of circumference of seal bead 39. Therefore, seal bead 39 is pressed downward in sliding engagement with second seal member 35 for substantial distances, up to twelve or fourteen feet. The sliding interface seal 31 of the present invention is a "dynamic" seal in that it may be assembled, disassembled, or repositioned within the wellbore numerous times without affecting the integrity of the seal.

Figure 5:
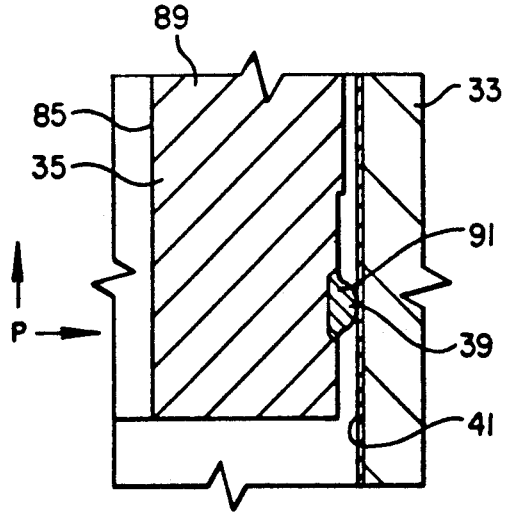
FIGS. 5 and 6 depict the interface region between the first and second seal members of FIG. 4 with a seal bead seated in a sealing region.
Figure 6:
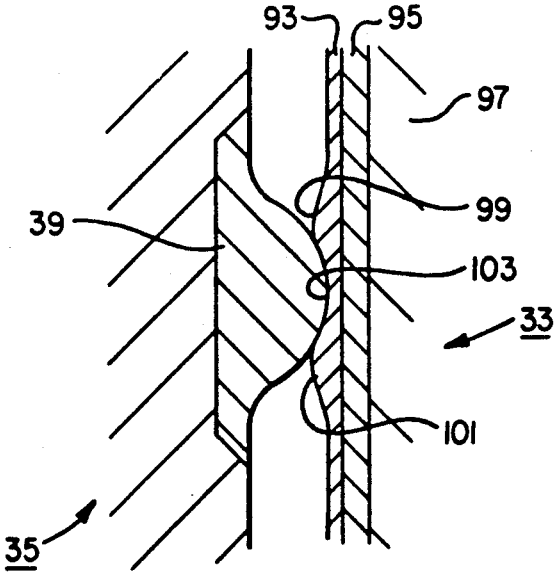

FIGS. 5 and 6 show the sliding interface seal 31 of the present invention in greater detail. As shown in FIG. 5, second seal member 35 includes base material 89 which carries a section of hardfacing 91. Hardfacing 91 has been machined to form a rounded cross-section seal bead 39. Seal bead 39 is seated in seal region 41. In one embodiment seal region 41 may comprise a friction reducing plastic material such as Teflon which is sprayed onto the inner bore of first seal member 33 and baked. For example, soft FEP Teflon, manufactured by E. I. DuPont de Nemours & Company, may be used to form a seal coating in seal region 41. If a FEP Teflon is employed, it is recommended that it be applied to second seal member by conventional means, in a thickness of at least 0.002 inches. Alternately, as shown in FIG. 6, seal region 41 may include one or more layers of a malleable metallic coating.

As shown in FIG. 6, seal region 41 may include outer coating 93 disposed above inner coating 95. Both coatings are carried by tubular member 97 which forms the body of first seal member 33. In the preferred embodiment, tubular member 97 is composed of 4140 steel, which has a yield strength of 110,000 pounds per square inch, and has a hardness of thirty (30) on the Rockwell C scale.

In the preferred embodiment, inner coating 95 comprises a layer of metal which is between ten thousand and fifteen thousand angstroms thick. In the preferred embodiment, inner coating 95 is composed of an aluminum bronze alloy which is not as hard as, and is more malleable than, the material which forms tubular member 97.

In the preferred embodiment, outer coating 93 is a ten thousand to fifteen thousand angstroms thick layer of material which is less hard, and more malleable, than, inner coating 95. In the preferred embodiment, outer coating 93 is composed of a silver palladium alloy.

In the preferred embodiment, seal bead 39 is composed of a material which is harder (and less malleable) than tubular member 97, inner coating 95 and outer coating 93. Preferably, seal bead 39 is formed of a nickle chrome alloy which has a hardness of approximately forty (40) on the Rockwell C scale. In the preferred embodiment, seal bead 39 is composed of between thirteen to fifteen percent (13%–15%) chrome, two percent (2%) Boron, and the remainder of nickle.

Of course, it is possible that other materials and alloys be substituted for those used in the preferred embodiment. For example, it may be possible to supplement gold alloys, tin, or lead tin alloys for outer coating 93. It may also be possible to substitute titanium, or chrome gold alloys for inner coating 95. The present invention only requires that inner and outer coatings 95, 93 have a hardness and malleability which is less than that of tubular member 97 and seal bead 39.

As stated above, in wellbore applications, tubular member 97 will have a hardness of thirty (30) on the Rockwell C scale, and seal bead 39 will have a hardness of forty (40) on the Rockwell C scale. Preferably, inner and outer coatings 93, 95 will have a hardness between forty and sixty on the Rockwell B scale, and outer coating 93 will be more malleable (and less hard) than inner coating 95.

The relatively soft coatings of inner and outer coatings 95, 93 serve to fill in machining marks and scratches that develop during use. These coatings also function as anti-galling coatings, and must stay on during repeated use. As shown in FIG. 6, outer coating 93 will deform in regions 99, 101 around seal bead 39 to form a seat 103. It is important that seal bead 39 be hard enough to withstand repeated sliding engagement with first seal member 33.

In the preferred embodiment, outer and inner coatings 93, 95 are actually diffused into tubular member 97 through known ionic material deposition technologies, in which ions of metals such as silver are combined with ions of other metals, such as chromium or palladium, and embedded in the crystalline matrix of the metal surface to become an integral part of the surface, and not just a film coating. In ion plating processes, clouds of electrons are produced in very strong magnetic fields. Atoms of coating material passing through the electron clouds from the source of alloy material will be ionized by electron collision. The positive ions thus formed are accelerated in the intense field to an extremely high velocity and impact and penetrate the negative charged surface of the metal material. The result is a diffusion of metals into and below the surface of the base material.

The following U.S. patents and published articles describe generally the ion plating processes which can be used to deposit outer and inner coatings 93, 95, and are incorporated herein by reference fully as if set forth herein:

(1) U.S. Pat. No. 4,468,309, entitled "Method of Resisting Galling", issued to White on Aug. 28, 1984;

(2) U.S. Pat. No. 4,420,386, entitled "Method of Pure Ion Plating Using Magnetic Fields", issued to White on Dec. 13, 1983;

(3) U.S. Pat. No. 4,342,631, entitled "Gasless Ion Plating Process and Apparatus", issued to White et al on Aug. 3, 1982;

(4) U.S. Pat. No. RE 30,401, entitled "Gasless Ion Plating", issued to White on Sept. 9, 1980;

(5) SPE Paper No. 12209, entitled "Eliminating Galling in High-Alloy Tubular Threads by High Energy Ion Deposition Process", by G. W. White;

(6) "Fundamental Parameters of Ion Plating", published in the March 1974 issue of Metal Finishing, pages 41 through 45, authored by Lewis Beebe Leder;

(7) "Fundamentals of Ion Plating" published in the January/February 1973 issue of Journal of Vacuum Science & Technology, authored by D. M. Mattox;

(8) "Frictional and Morphological Characteristics of Ion-Plated Soft Metallic Films", published in the Oct. 16, 1981 issue of Thin Solid Films, pages 267 through 272, authored by Talivaldis Spalvins and Bruno Buzek;

(9) "Commercial Applications of Overlay Coating Techniques", published in the Oct. 16, 1981 issue of Thin Solid Films, pages 361 through 365, authored by D. M. Mattox; and

(10) "Coatings for Wear and Lubrication", published in the Sept. 15, 1978 issue of Thin Solid Films, pages 285 through 300, authored by Talivaldis Spalvins.

Put simply, the ion-plating technique requires that the material to be deposited on the substrate be evaporated via resistance heating, electron-beam impingement, or induction heating, then ionized and accelerated through the discharge, and finally deposited on the substrate.

While ion plating is the preferred means of depositing the coating materials on the substrate, a variety of alternative techniques are available. The October, 1981 article in thin solid films entitled "Commercial Applications of Overlay Coating Techniques", by D. M. Mattox sets forth on page 362 in tabular form a number of competing techniques for fabricating coatings. These techniques are grouped together in four broad categories atomistic deposition; particulate deposition; bulk coatings; and surface modification. It is possible that one or more of these competing techniques may also serve to deposit seal coatings on first seal member 33 in a satisfactory manner.

In the area of ion plating, great potential in the plating of soft metallic forms has been reported, including the use of gold, silver, lead, indium, tin, and cadnium (see generally the article entitled "Coatings for Wear and Lubrication," page 296, and the references cited therein). As set forth in SPE Paper No. 12209, entitled "Eliminating Galling in High-Alloy Tubular Threads By High-Energy Ion Deposition Process" anti-galling layers have been deposited on threaded wellbore tubular members with favorable results.

Several commercially-available ion-deposition processes are available, including the Bakertron process which is offered by Baker Packers, a division of Baker Oil Tools, Inc., an operating division of Baker Hughes Incorporated, assignee of this patent, located at 6023 Navigation Boulevard, Houston, Tex. 77011. Test results have demonstrated thicker coatings than possible under the Bakertron process produce a better seal coating. The Bakertron process allows for coatings of two thousand to three thousand angstroms thick. In the preferred embodiment, for best results, the metal coating should each be approximately ten thousand to fifteen thousand angstroms thick.

In the Bakertron process, ions of noble metals, such as gold or silver, are combined with ions of chromium or palladium, and are embedded into the crystalline matrix of the metal surface to become an integral part of the surface. In the Bakertron process, clouds of electrons are produced in a very strong magnetic field. Any atom passing through these electron clouds from the source of the alloy material will be ionized by electronic collision. The positive ions thus formed are accelerated in the intense field to an extremely high velocity and impact and penetrate the negatively charged surface of the coupling threads or other wellbore tubular member. The result is a diffusion of the coating metals into and below the surface of the alloy. When used on tubular members, under makeup the noble metals shear or slip, reducing friction and most importantly staying embedded in the metal matrix, preventing contact of the high alloy surfaces, cold welding, and subsequent galling.

In the preferred embodiment, the ion deposition process is used to first deposit aluminum-bronze on first seal member 3. The preferred composition of aluminum-bronze conforms to the following percentages by weight in accordance with ASTM E54 or E478 (that is, the Philadelphia-based American Society for Testing of Materials Publication Nos. E54 or E478):

| Element | Minimum Percent | Maximum Percent |
|---|---|---|
| 1. Copper and other elements listed | 99.5 | — |
| 2. Aluminum | 6.3 | 7.6 |
| 3. Iron | 0.0 | 0.3 |
| 4. Nickel | 0.0 | 0.25 |
| 5. Manganese | 0.0 | 0.10 |
| 6. Silicone | 1.5 | 2.2 |
| 7. Tin | 0.0 | 0.2 |
| 8. Zinc | 0.0 | 0.5 |
| 9. Lead | 0.0 | 0.05 |
| 10. Arsenic | 0.0 | 0.15 |

In the preferred embodiment, the ion deposition process is used to deposit silver-palladium which is evaporated in the ion deposition chamber. Preferably, the material to be evaporated comprises eighty percent by weight silver and twenty percent by weight palladium, plus or minus two percent for each element.

Figure 7:
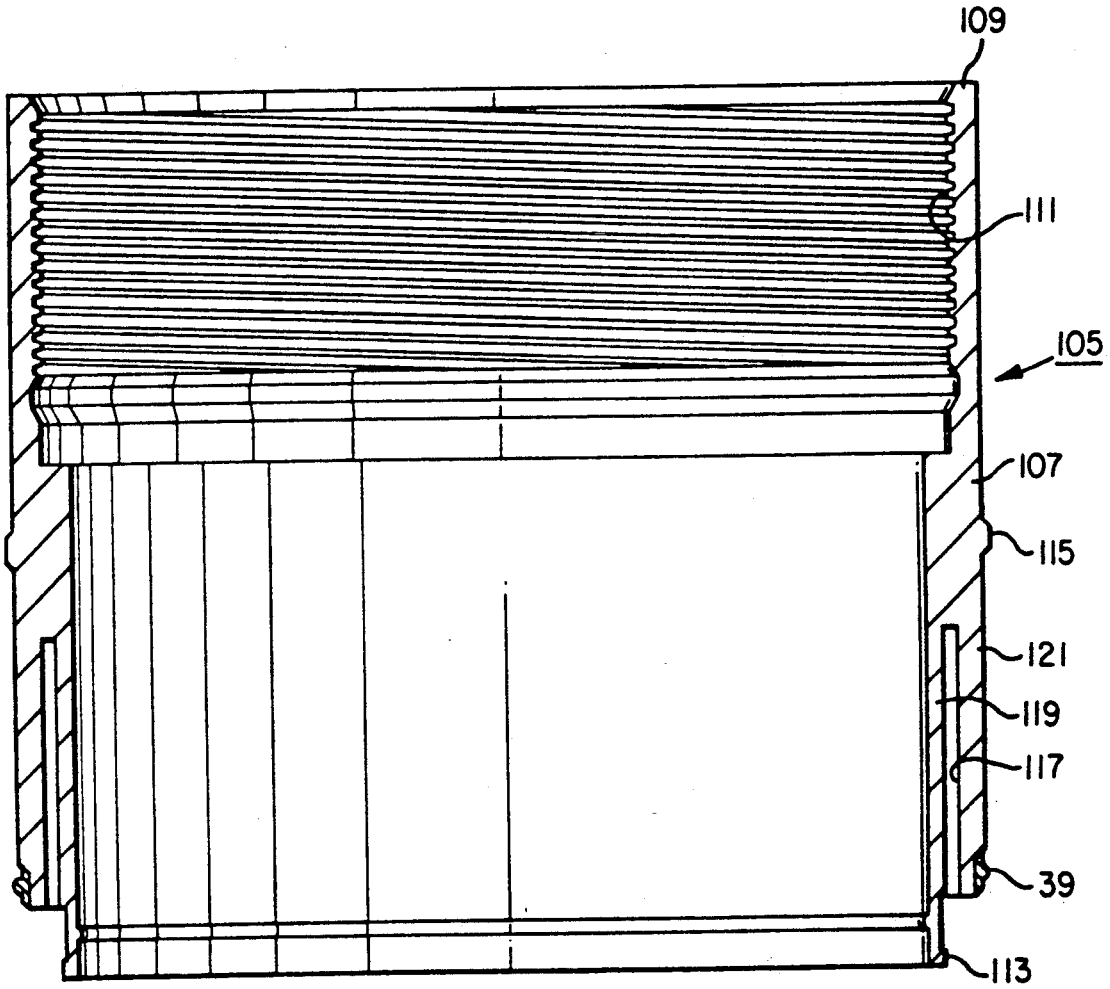
FIG. 7 depicts an alternative embodiment of the second seal member of the sliding interface seal of the present invention, in longitudinal section.

An alternative embodiment for the sliding interface seal 31 of the present invention is depicted in FIGS. 7 through 10. FIG. 7 depicts in longitudinal section an alternative second seal member 105. Second seal member 105 is composed of tubular body 107 which has internal threads 111 at upper end 109 and shoulder 115 disposed at a position intermediate of upper end 109 and lower end 113. Seal bead 39 is disposed near lower end 113, and radially outward from boost slot 117. In this embodiment, seal bead 39 is composed of a hardfacing material, like seal bead 39 of the embodiment of FIGS. 3 and 4.

In the embodiment of FIG. 7, tubular body 107 defines boost slot 117 between inner wall 119, and outer wall 121. In the preferred embodiment boost slot 117 is machined into tubular body 107 and is one and one-half (1½) inches deep. Wellbore fluid within boost slot 117 exerts pressure radially outward against outer wall 121, which is in the preferred embodiment one-quarter (¼) inch thick, causing seal bead 39 to embed in a seal coating. Boost slot 117 is designed to provide three-quarters (¾) of a square inch of area along the inner surface of outer wall 121 per one (1) inch of line contact of seal bead 39.

Figure 8:
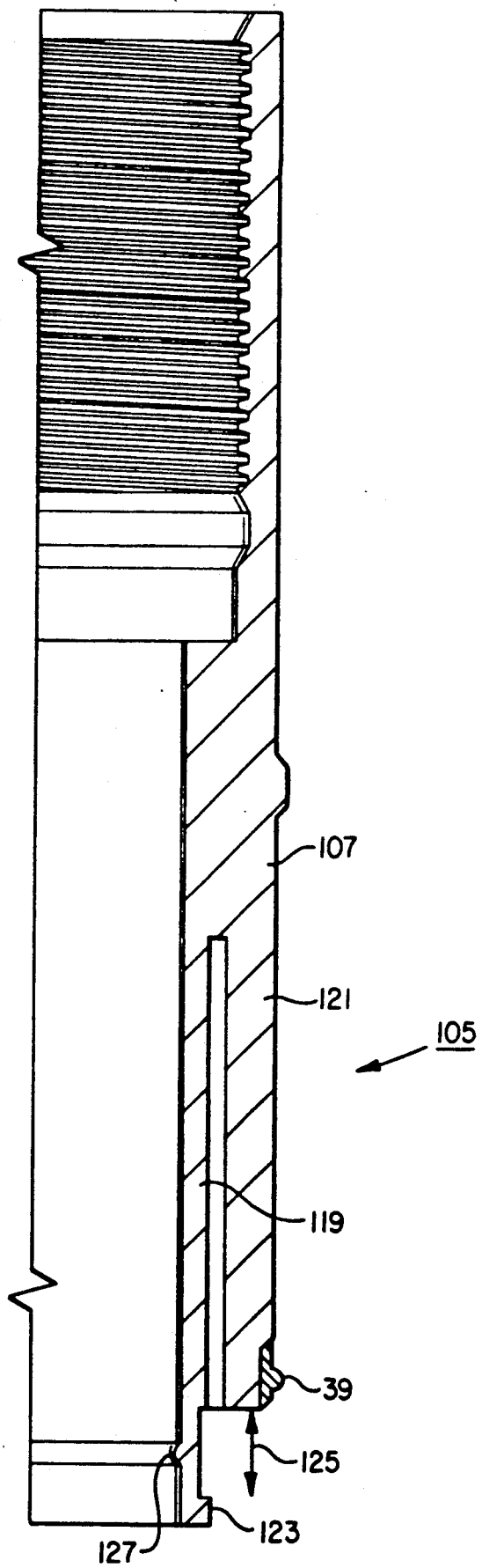
FIG. 8 further depicts the alternative embodiment of FIG. 7, in one-quarter longitudinal section.

FIG. 8 is a one-quarter longitudinal section of alternative second seal member 105 of FIG. 7. As shown in FIG. 8, inner wall 119 extends downward beyond outer wall 121, and terminates at lip 123 which extends radially outward from inner wall 119. The region 125 from the lower end of outer wall 121 and lip 123 of inner wall 119 defines a region adapted for receipt of a mandrel clamp which serves to clamp inner wall 119 against a mandrel, and in particular causing mandrel bead 127 to engage the mandrel.

Figure 9:
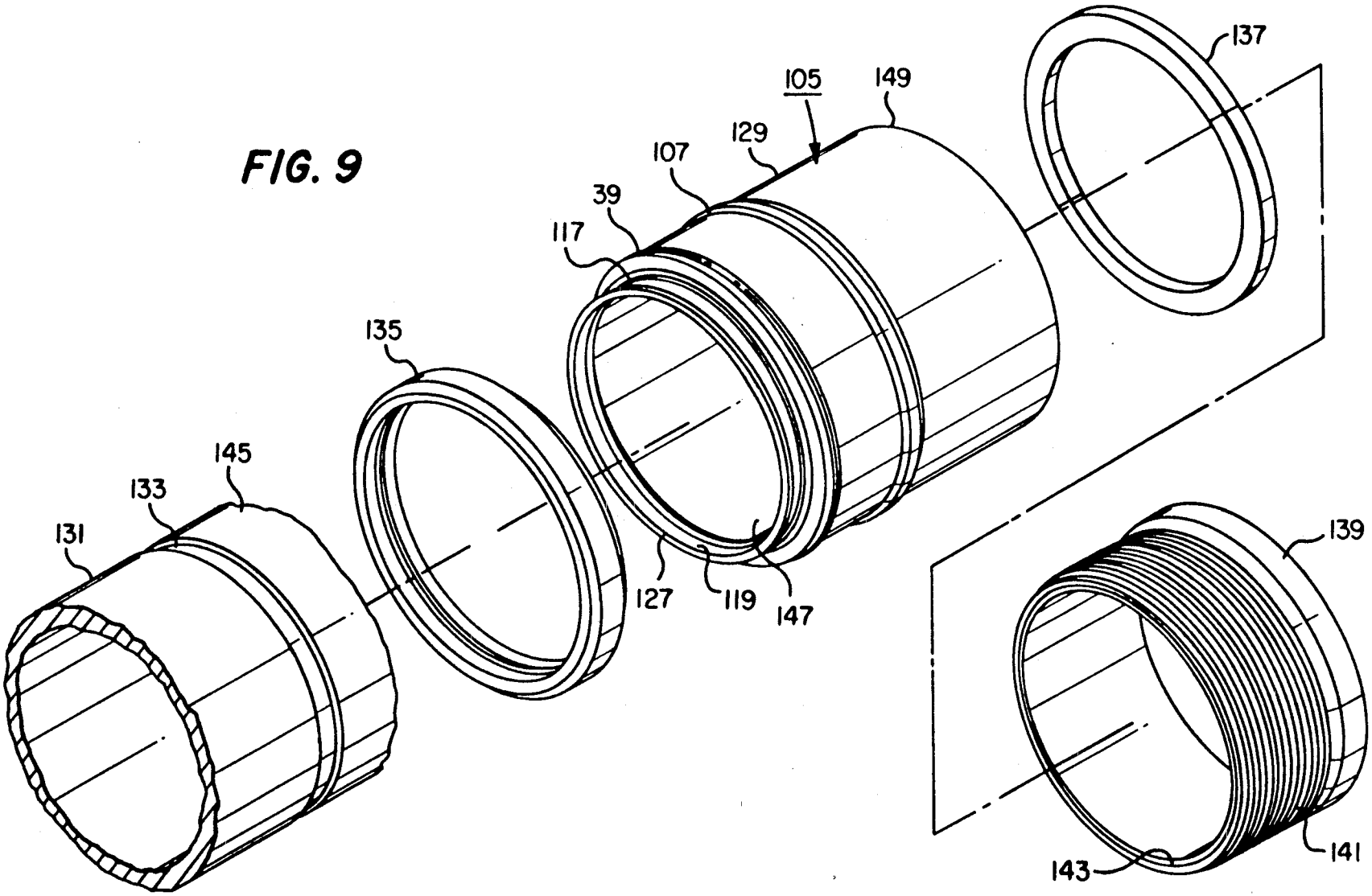
FIG. 9 depicts, in exploded form, the alternative embodiment of the second seal member of the sliding interface seal of FIGS. 7 and 8, including the assembly used to hold said second seal member in place.
Figure 10:
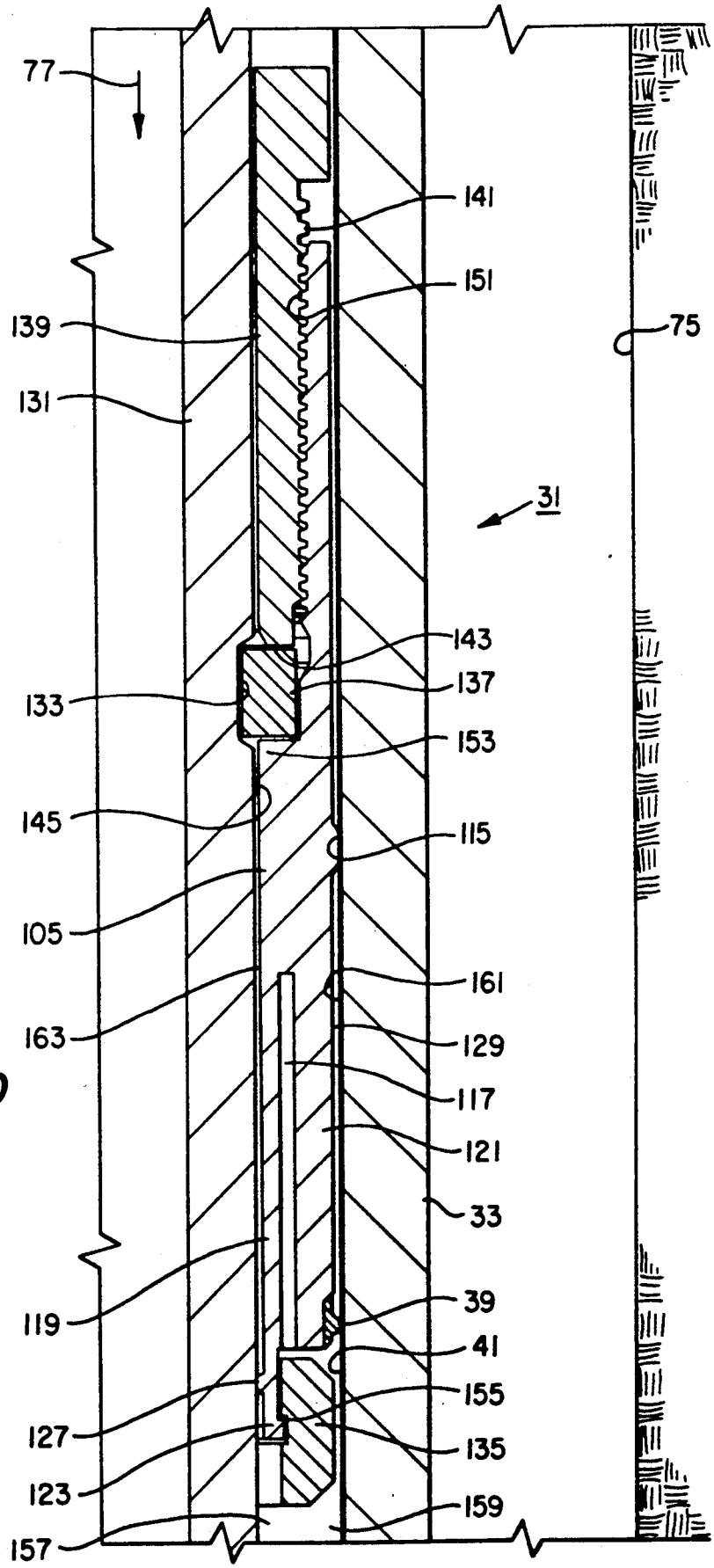
FIG. 10 depicts the alternative embodiment of the sliding interface seal of FIGS. 7 through 9, disposed within a wellbore, in one-quarter longitudinal section.

FIG. 9 is an exploded view of alternative second seal member 105 and the assembly which holds second seal member 105 in position within a wellbore. As shown, mandrel 131 includes split ring groove 133 on exterior cylindrical surface 145. Mandrel is positioned in interior 147 of second seal member 105, and receives split ring 137 in split ring groove 133. Seal retainer member 139 is mated within internal threads at upper end 149 of second seal member 105 (internal threads are not shown in FIG. 9, but are shown in FIG. 10). Lower end 143 of seal retainer member 139 serves to abut split ring 137 and hold it in position. Full-ring mandrel clamp 135 is heated to expand the metallic material from which it is composed and is raised upward along the length of mandrel 131, and positioned over inner wall 119 in region 125 between the lower end of outer wall 121 and 123 of inner wall 119. As full-ring mandrel clamp 135 shrinks due to cooling, it will exert force on inner wall 119, and cause mandrel bead 127 to grip the exterior cylindrical surface 145 of mandrel 131.

This assembly is further depicted in FIG. 10, which is a one-quarter longitudinal section of sliding interface seal 31 of the present invention disposed within wellbore 75. As in the other embodiment, first seal member 33 comprises a cylindrical tubular member with seal region 41 disposed on its inner bore. Alternative second seal member 105 is carried downward within wellbore 75 in the direction of arrow 77 by mandrel 131 which includes split ring groove 133 on its outer cylindrical surface 145. Split ring 137 is disposed within split ring groove 133, and held in place by lower end 143 of sealing retainer member 139 which treadably engages internal threads 151 of second seal member 105 with external threads 141. Split ring 137 is held in position from below by shoulder 153 which is formed in second seal member 105.

As shown in FIG. 10, shoulder 115 on the exterior cylindrical surface 129 of second seal member 105 abuts first seal member 133, as does hard-faced seal bead 39. Inner wall 119 and outer wall 121 are separated by a cylindrical-shaped boost slot 117 which is disposed radially inward from seal bead 139.

Full-ring mandrel clamp 135 extends over lip 123, and includes mandrel slot 155 for accommodating lip 123. One-half of full-ring mandrel clamp 135 rides in region 125 of FIG. 8, and it urges mandrel bead 127 into sealing engagement with exterior cylindrical surface 145 of mandrel 131. In a further alternative of the present invention, it may be possible to form mandrel bead 127 from hard-facing material, and apply a seal coating to exterior surface 145 of mandrel 131.

In operation, pressurized fluid 159 (either gaseous, liquid, or a combination of gaseous and liquid fluids) in pressurized region 157 communicates with boost slot 117. As a pressure differential is developed between pressurized region 157 and less-pressurized regions 161, 163, outer wall 112 is urged radially outward, and inner wall 119 is urged radially inward. As outer wall 121 is urged radially outward, seal bead 39 is caused to sealingly engage seal region 41. As the pressure differential increases, inner wall 119 is caused to expand slightly radially inward, causing mandrel bead 127 to sealingly engage mandrel 131. As the pressure differential increases, the sealing engagement between seal bead 39 and seal coating 41 is enhanced. Likewise, as the pressure differential increases the sealing engagement between mandrel bead 127 and mandrel 131 is enhanced. Therefore, the seal of the present invention is one which increases and decreases in sealing engagement depending upon the pressure differential developed between the pressurized region 157 and less-pressurized regions 161, 163.

Of course, as with the other embodiment, seal region 41 may include one or more plastic or metallic layers of sealing coatings, deposited in the manner described above.

Under the several embodiments of the present invention, it is one primary objective to provide a seal which is functional at a sliding interface between first and second seal members. Such a seal would allow for the assembly, disassembly, and readjustment of the seal on numerous occasions, without degradation or destruction of the sealing ability.

Experiments reveal that the use of plastic coatings on first seal member 33, such as soft FEP Teflon, provided a seal which could be made up several times without impairment of the seal integrity. Further experiments revealed that use of an aluminum-bronze and silver-palladium coatings applied through the Bakertron process provided a good, but not bubble-tight, seal which could be made up and broken in excess of a dozen times without impairment of the sealing ability. Still further tests revealed that a combination of thicker aluminum-bronze and silver-palladium coatings deposited, each having a thickness in the range of ten thousand to fifteen thousand angstroms, allowed for a tighter (bubble-tight) seal which could be made up and broken in excess of a dozen times without impairment of the sealing ability.

It is possible that other seal coatings will be equally or more effective than those discussed above. For example, it may be possible that epoxy coatings, polyurethane coatings, Tefzel brand coating from DuPont, or Ryton coatings from Phillips Petroleum will be equally or more effective than Teflon or metal coatings.

Tests have revealed that the sliding interface seal 31 of the embodiment of FIGS. 3 and 4 provides a good seal at 8,000 psi nitrogen and 10,000 psi water. The boost area 85 can withstand up to 100,000 psi, but the mandrel seal formed by split ring 63, spacer 61, and soft brass ring 59 can only withstand 8,000 to 10,000 psi. Experiments further reveal that second seal member 35 of the embodiment depicted in FIGS. 3 and 4 begins effective sealing in a pressure range of approximately 1 to 1.5 thousand pounds per square inch. Experiments reveal that second seal member 35 of this embodiment will accommodate increases in pressure and continue sealing up to the limits in strength of mandrel 51 and the tubular member of first seal member 33. Further tests reveal that the mandrel seal of the embodiment of FIGS. 9 and 10 can withstand pressures up to 8,000 psi, which is the yield strength of outer wall 121.

Experiments also reveal that, for both embodiments, if the pressure differential between the pressurized region and the less-pressurized region is less than 1,000 psi, the sliding interface seal 31 of the present invention may repositioned within a wellbore by sliding one or both of first and second seal members 33, 35, relative to the other. Therefore, the first and second seal members are repositionable relative to each other while maintaining a sealing engagement, at low pressure differentials.

In summary, the sliding interface seal of the present invention provides a seal in which the seal components may be slidably engaging one another at a sliding interface. The sliding interface seal of the present invention also provides a seal which increases and decreases in sealing engagement in response to changes in pressure of the contained fluid. The sliding interface seal of the present invention also provides a seal which is especially adapted for use in wellbores. The sliding interface seal of the present invention allows for a seal which may be assembled, disassembled, or adjusted by sliding one seal member relative to another seal member under low pressure differential conditions.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A seal apparatus for containing fluid under variable pressure in a pressurized region to prevent leakage into a less-pressurized region comprising:

first and second interfacing seal members adapted to slidably engage one another at an interface region during makeup of said seal apparatus;

a seal region carried by said first seal member at said interface region and composed of a deformable material;

a seal bead carried at said interface region by said second seal member and protruding therefrom, said seal bead being composed of a material less malleable than said seal region for seating in said seal region;

wherein at least a portion of said second seal member adjacent said seal bead forms a containment barrier with said pressurized region on one side and said less-pressurized region on the opposite side; and wherein a pressure differential developed between said pressurized region and said less-pressurized region urges said seal bead into tighter engagement with said seal region in an amount corresponding to said pressure differential.

2. A seal apparatus according to claim 1, wherein said first and second seal members comprise concentrically interlocking tubular members.

3. A seal apparatus according to claim 1, wherein said seal bead is semi-circular in cross-section.

4. A seal apparatus according to claim 1, wherein said seal region comprises a plurality of coatings of differing malleability.

5. A seal apparatus according to claim 1, wherein said seal region comprises at least one metallic layer bonded directly to said first seal member.

6. A seal apparatus according to claim 1, wherein said seal region comprises at least one metallic layer bonded directly to said first seal member by an ion deposition process.

7. A seal apparatus according to claim 1, wherein said seal bead comprises a region of metal hardfacing.

8. A seal apparatus according to claim 1, wherein during an adjustment mode of operation with said pressure differential below an adjustment pressure threshold said first and second seal members may be repositioned relative to each other while maintaining a sealing engagement between said seal region and said seal bead.

9. A seal apparatus for containing fluid under pressure in a pressurized region, comprising:

a first seal member defining at least in-part said pressurized region and having a seal bore of a selected shape disposed along a longitudinal axis, said seal bore having a selected inner dimension and coated at least in-part in a sealing region with a seal coating composed of a malleable layer which is bonded directly to said seal bore;

a second seal member having an outer surface which is disposed about a longitudinal axis and which has a selected shape corresponding to said selected shape of said seal bore of said first seal member, said second seal member having an outer dimension larger than said selected inner dimension of said seal bore of said first seal member;

a seal bead peripherally disposed on said outer surface of said second seal member, raised a selected distance above said outer surface, and composed of a material less malleable than said seal coating of said first seal member;

said second seal member also having a boost area disposed radially inward from said seal bead which communicates with said pressurized region;

wherein during a makeup mode said second seal member is aligned said seal bore of said first seal member and said first and second seal members are fitted together by force, causing said seal bead to becomes embedded in said seal coating of said sealing region of said seal bore; and wherein during a sealing mode said pressurized fluid exerts force radially outward on said boost area to urge at least a portion of said second seal member radially outward to press said seal bead into sealing engagement with said seal coating of said seal bore.

10. A seal apparatus according to claim 9, wherein said first and second seal members comprise tubular members.

11. A seal apparatus according to claim 9, wherein said seal bore of said first seal member is cylindrical in shape, and wherein said outer surface of said second seal member is also cylindrical in shape.

12. A seal apparatus according to claim 9, wherein said seal coating comprises a malleable metallic layer which is bonded directly to said seal bore.

13. A seal apparatus according to claim 9, wherein said seal bead comprises a peripherally disposed bead which is rounded in cross-section, and which is composed of a metallic material which is less malleable than said seal coating of said first seal member.

14. A seal apparatus according to claim 9, wherein during said sealing mode said sealing engagement between said seal bead and said seal bore is proportional in strength to said pressure of said pressurized fluid.

15. A seal apparatus according to claim 9, wherein said malleable layer of said seal coating conforms in shape to accommodate said seal bead.

16. A seal apparatus according to claim 9, wherein during a removal mode said first and second seal members are repositionable relative to each other while maintaining a sealing engagement.

17. A seal apparatus according to claim 9, wherein said seal coating is bonded directly to said seal bore by an ion metallizing process.

18. A seal apparatus according to claim 9, wherein said seal coating comprises two layers with an upper coating disposed over a lower coating, and wherein said upper coating is more malleable than said lower coating.

19. A seal apparatus according to claim 9, wherein during said makeup mode said seal bead slidingly engages said seal bore as said first and second seal members are forced together.

20. A seal apparatus according to claim 9, wherein said seal bead and said seal coating cooperate to form a bubble-tight seal.

21. A seal apparatus for use in a wellbore to contain pressurized wellbore fluid, comprising:

a first wellbore tubular member having a seal bore centrally disposed therethrough along a central longitudinal axis, said seal bore having a selected inner diameter and coated at least in-part in a sealing region with a seal coating composed of a malleable metallic layer which is bonded directly to said seal bore;

a second wellbore tubular member having a outer cylindrical surface which is disposed about a central longitudinal axis with an outer diameter larger than said selected inner diameter of said seal bore of said first wellbore tubular member;

a seal bead circumferentially disposed on said outer cylindrical surface of said second wellbore tubular member, raised a selected distance above said outer cylindrical surface, and composed of a metallic material less malleable than said seal coating;

said second wellbore tubular member also having a central bore disposed therethrough along said central longitudinal axis, said central bore at least in-part defining a boost area disposed radially inward from said seal bead;

wherein during a makeup mode said second wellbore tubular member is axially aligned said seal bore of said first wellbore tubular member and said first and second wellbore tubular members are fitted together by application of force along said central longitudinal axes to cause said seal bead to become embedded in said seal coating of said sealing region of said seal bore; and wherein during a sealing mode said pressurized wellbore fluid exerts force radially outward on said boost area to urge said seal bore radially outward into sealing engagement with said seal bore, said sealing engagement corresponding in strength to the pressure of said pressurized wellbore fluid.

22. A seal apparatus according to claim 21, wherein said first wellbore tubular member is composed of a metal less malleable than said seal coating.

23. A seal apparatus according to claim 21, wherein said seal bead carried by said second tubular member is composed of a metallic material less malleable than a metallic material which comprises said second tubular member.

24. A seal apparatus according to claim 21, wherein said seal bead is semi-circular in cross-section.

25. A seal apparatus according to claim 21, wherein said boost area comprises a region of said central bore of said second tubular member radially inward from said seal bead.

26. A seal apparatus according to claim 21, wherein said boost area comprises an annular cavity disposed between said central bore of said second wellbore tubular member and said outer cylindrical surface of said second wellbore tubular member.

27. A seal apparatus according to claim 21, wherein said seal coating is bonded directly to said seal bore by an ion metallizing process.

28. A seal apparatus according to claim 21, Wherein said seal coating comprises an upper coating disposed over a lower coating, and wherein said upper coating is more malleable than said lower coating.

29. A seal apparatus according to claim 21, wherein said seal coating comprises an upper coating of silver palladium alloy disposed over a lower coating of aluminum bronze alloy.

30. A seal apparatus according to claim 21, wherein said seal bead is composed of a hardfacing alloy.

31. A seal apparatus according to claim 21, Wherein said seal bead comprises a hardface alloy ring circumferentially disposed about said second wellbore tubular member which is semicircular in cross-section, defining a circumferential seal point.

32. A seal apparatus according to claim 21, wherein during said makeup mode said second wellbore tubular member is lowered within said wellbore and press fit within said first wellbore tubular member while said first wellbore tubular member is fixedly disposed within said wellbore.

33. A seal apparatus according to claim 21, wherein during said makeup mode said second wellbore tubular member is coupled to a mandrel, lowered into said wellbore, and press fit within said seal bore of said first wellbore tubular member.

34. A seal apparatus according to claim 21, wherein during said makeup mode said seal bead slidingly engages said seal bore as said first and second wellbore tubular members are forced together.

35. A seal apparatus according to claim 21, further comprising:

a mandrel having a cylindrical exterior surface;

means for coupling said second wellbore tubular member to said cylindrical exterior surface of said mandrel; and means for sealing said second wellbore tubular member at said mandrel.

36. A seal apparatus according to claim 21, wherein said seal coating comprises a plastic coating.

37. A seal apparatus according to claim 21, wherein said seal coating comprises Teflon-type coating.

38. A seal apparatus according to claim 21, wherein said seal bead and said seal coating cooperate to form a bubble-tight seal.

39. A method of sealing to prevent passage of pressurized fluid from a pressurized region to a less-pressurized region, comprising:

providing first and second interlocking seal members;

providing a deformable seal coating on said first seal member;

providing a protruding seal bead on said second seal member;

sliding said first and second interlocking seal members together, with said seal bead extending into said deformable layer;

forcing said seal bead into tighter contact with said seal coating in an amount corresponding to a pressure differential between said pressurized region and said less-pressurized region.

40. A method of sealing to prevent passage of pressurized fluid from a pressurized region to a less-pressurized region, comprising:

providing first and second interlocking seal members;

providing a metallic deformable seal coating on said first seal member;

providing a protruding seal bead on said second seal member;

sliding said first and second interlocking seal members together with said seal bead extending into said deformable layer; and forcing said seal bead into tighter contact with said seal coating in an amount corresponding to a pressure differential between said pressurized region and said less-pressurized region.

41. A method of sealing in a wellbore to prevent passage of pressurized fluid from a pressurized region to a less-pressurized region, comprising:

providing a first tubular member with a seal bore disposed therethrough, said seal bore coated at least in-part in a sealing region with a seal coating of malleable and deformable material;

providing a second tubular member having an outer cylindrical surface adapted in size for force fitting into said seal bore of said first tubular member;

providing a seal bead on said outer cylindrical surface of said second tubular member, raised a selected distance above said outer cylindrical surface, and composed of a material less malleable than said seal coating;

providing a boost region radially inward from said seal bead which is subject to pressurized fluid from said pressurized region;

disposing said first tubular member in said wellbore for bounding in-part said pressurized region with said seal bore;

aligning said second tubular member in said wellbore with said first tubular member;

force-fitting said second tubular into said seal bore of said first tubular member, wherein said seal bead extends into said seal coating; and allowing pressurized fluid from said pressurized region to act in said boost region to urge said seal bead into tighter engagement with said seal coating.

42. A method of sealing according to claim 41, further comprising:

automatically varying said engagement between said seal coating and said seal bead in response to increased pressure within said pressurized region.

* * * * *